US010837133B2

(12) United States Patent
Kim et al.

(10) Patent No.: US 10,837,133 B2
(45) Date of Patent: Nov. 17, 2020

(54) MELT-BLOWN FIBER WEB WITH IMPROVED CONCENTRATION FORCE AND ELASTICITY AND METHOD AND APPARATUS FOR MANUFACTURING THE SAME

(71) Applicants: Hyundai Motor Company, Seoul (KR); Kia Motor Company, Seoul (KR); Iksung Co., Ltd., Eumseong-gun (KR)

(72) Inventors: Min Su Kim, Ulsan (KR); Jung Wook Lee, Gyeonggi-do (KR); Jae CHan Lim, Ulsan (KR); Won Jin Seo, Gyeonggi-do (KR); Hyeon Ho Kim, Gyeonggi-do (KR); Jong Hyuk Cha, Chungcheongbuk-do (KR); Ki Wook Yang, Chungcheongbuk-do (KR); Bong Jik Lee, Gyeonggi-do (KR)

(73) Assignees: Hyundai Motor Company, Seoul (KR); Kia Motor Company, Seoul (KR); Iksung Co., Ltd., Eumseong-gun (KR)

( * ) Notice: Subject to any disclaimer, the term of this patent is extended or adjusted under 35 U.S.C. 154(b) by 0 days.

(21) Appl. No.: 15/672,242

(22) Filed: Aug. 8, 2017

(65) Prior Publication Data

US 2017/0342615 A1 Nov. 30, 2017

Related U.S. Application Data

(62) Division of application No. 14/070,844, filed on Nov. 4, 2013, now abandoned.

(30) Foreign Application Priority Data

Nov. 8, 2012 (KR) ..... 10-2012-0125856

(51) Int. Cl.
*D04H 1/00* (2006.01)
*D04H 3/00* (2012.01)
(Continued)

(52) U.S. Cl.
CPC ..... *D04H 1/56* (2013.01); *D04H 3/16* (2013.01); *Y10T 156/1041* (2015.01); *Y10T 156/1054* (2015.01); *Y10T 442/601* (2015.04)

(58) Field of Classification Search
CPC ..... B32B 37/0067; B29C 66/43; D04H 1/56; D04H 3/16
(Continued)

(56) References Cited

U.S. PATENT DOCUMENTS 3,043,733 A * 7/1962 Harmon ..... D06M 17/00 156/209
5,549,964 A 8/1996 Shohji et al.
(Continued)

FOREIGN PATENT DOCUMENTS

CN 1382083 A 11/2002
CN 101006219 A 7/2007
(Continued)

OTHER PUBLICATIONS

Office Action for Chinese Patent Application No. 2013105493551, dated Nov. 16, 2016, English translation, 20 pages.

*Primary Examiner* — Linda L Gray
(74) *Attorney, Agent, or Firm* — Mintz Levin Cohn Ferris Glovsky and Popeo, P.C.; Peter F. Corless

(57) ABSTRACT

Disclosed is a melt-blown fiber web with improved concentration force and elasticity, whereby a melt-blown fabric is cut and sealed at predetermined intervals using knives having arbitrary patterns so that concentration force and elasticity of the melt-blown fiber web can be improved without degrading the inherent function of the fiber web.
(Continued)

Further disclosed are a method and apparatus for manufacturing the melt-blown fiber web. The melt-blown fiber web includes thermoplastic filaments, wherein cutting portions and sealing portions are arranged on top and bottom surfaces of the fiber web at predetermined intervals along a thickness of the fiber web so that a concentration force and elasticity of the fiber web are improved.

2 Claims, 7 Drawing Sheets

(51) Int. Cl.
*B32B 37/00* (2006.01)
*D04H 1/56* (2006.01)
*D04H 3/16* (2006.01)

(58) Field of Classification Search
USPC ..... 156/251, 308.4, 290
See application file for complete search history.

(56) References Cited

U.S. PATENT DOCUMENTS

| | | | | |
|---|---|---|---|---|
| 5,620,779 | A | 4/1997 | Levy et al. | |
| 5,789,065 | A | 8/1998 | Haffner et al. | |
| 5,804,021 | A | 9/1998 | Abuto et al. | |
| 2002/0036062 | A1 | 3/2002 | Kauschke et al. | |
| 2002/0114918 | A1 | 8/2002 | Mossbeck et al. | |
| 2003/0124306 | A1 | 7/2003 | Morman | |
| 2005/0054255 | A1 | 3/2005 | Morman et al. | |
| 2005/0230034 | A1 | 10/2005 | Arora et al. | |
| 2008/0095978 | A1 | 4/2008 | Siqueira et al. | |
| 2008/0197316 | A1* | 8/2008 | Yang | D04H 1/60 252/62 |
| 2009/0305594 | A1 | 12/2009 | He et al. | |
| 2010/0201024 | A1 | 8/2010 | Gibson et al. | |
| 2010/0266818 | A1 | 10/2010 | Westwood et al. | |
| 2012/0148796 | A1 | 6/2012 | Welch et al. | |

FOREIGN PATENT DOCUMENTS

| | | | |
|---|---|---|---|
| JP | H02234967 | A | 9/1990 |
| JP | H02259151 | A | 10/1990 |
| JP | 05-009853 | | 1/1993 |
| JP | H0784697 | A | 3/1995 |
| JP | H08510798 | A | 11/1996 |
| JP | 2003-503538 | A | 1/2003 |
| JP | 2004-522868 | A | 7/2004 |
| JP | 2007-321292 | A | 12/2007 |
| JP | 2012-077401 | A | 4/2012 |
| JP | 2012-092475 | A | 5/2012 |
| WO | 0112427 | A1 | 2/2001 |
| WO | 2011/088106 | A2 | 7/2011 |
| WO | 2011080643 | A2 | 7/2011 |
| WO | 2012/125707 | A1 | 9/2012 |

* cited by examiner

MELT-BLOWN FIBER WEB WITH IMPROVED CONCENTRATION FORCE AND ELASTICITY AND METHOD AND APPARATUS FOR MANUFACTURING THE SAME

CROSS-REFERENCE TO RELATED PATENT APPLICATION

This Application is a Division of application Ser. No. 14/070,844 filed on Nov. 4, 2013 which claims the benefit of Korean Patent Application No. 10-2012-0125856 filed on Nov. 8, 2012 in the Korean Intellectual Property Office, the disclosure of which is incorporated herein in its entirety by reference.

BACKGROUND OF THE INVENTION

1. Field of the Invention

The present invention relates to a melt-blown fiber web with improved concentration force and elasticity and a method and apparatus for manufacturing the melt-blown fiber web.

2. Description of the Related Art

In general, a process of manufacturing a melt-blown fiber web includes a wave forming process in which filaments are extended and are formed into a wave by spraying a thermoplastic resin, such as polypropylene, onto the filaments in a vertical downward direction so as to allow a high-temperature and high-speed gas having constant temperature, pressure, and speed to collide with the filaments. The process further includes collecting and stacking the filaments in which the wave is formed to thereby form the fiber web.

Since melt-blown fine fibers that are manufactured in the above process have a very thin average diameter of about 0.3 to 10 μm, together with a very large surface area, the melt-blown fine fibers are widely used for various types of high-performance filters, wipers, oil-absorbing materials, heat insulation materials, and absorbers.

However, since the fine fibers that form the melt-blown fiber web have a low strength and a weak concentration force between the fine fibers, when the melt-blown fiber web is used without performing additional processing, the concentration of the fiber web may be easily destroyed.

In order to reinforce the strength of the fine fibers and the concentration force between the fine fibers, the melt-blown fiber web is subjected to additional processing prior to use.

For example, the strength of the fine fibers and the concentration force between the fine fibers can be reinforced by connecting arbitrary portions of the melt-blown fiber web using a high frequency treating device, or by sewing and fixing the melt-blown fibers.

However, when exiting methods are used, costs increase. Further, the fiber web becomes damaged when high frequency treatment or sewing is performed. Thus, the inherent function of the fiber web may be degraded, or the thickness of the fiber web may be very small.

SUMMARY OF THE INVENTION

The present invention provides a melt-blown fiber web with improved concentration force and elasticity. More particularly, the present invention provides a melt-blown fabric that is cut and sealed at predetermined intervals using knives having arbitrary patterns so that concentration force and elasticity of the melt-blown fiber web can be improved without degrading the inherent function of the fiber web. The present invention further provides a method and apparatus for manufacturing the melt-blown fiber web.

According to an aspect of the present invention, there is provided a melt-blown fiber web including thermoplastic filaments, wherein cutting portions and sealing portions are arranged on top and bottom surfaces of the fiber web at predetermined intervals along a thickness of the fiber web so that a concentration force and elasticity of the fiber web are improved.

According to various embodiments, the shape of each of the cutting portions and the sealing portions is at least one selected from the group consisting of a straight line shape, a cross shape, an X-shape, a circle, and a T-shape, or a combination thereof.

According to another aspect of the present invention, there is provided a method of manufacturing a melt-blown fiber web, the method including: manufacturing a melt-blown fiber web by melting, extruding, and radiating a thermoplastic resin composite, wherein a high-temperature and high-speed gas is allowed to collide with filaments simultaneously with radiation; forming cutting portions and sealing portions in predetermined patterns at predetermined intervals by applying a shearing force to a surface of the manufactured melt-blown fiber web using knives and by fusing the melt-blown fiber web by heat; and winding the melt-blown fiber web in which the cutting portions and the sealing portions are formed.

According to another aspect of the present invention, there is provided an apparatus for manufacturing a melt-blown fiber web using a thermoplastic resin, the melt-blown fiber web having improved concentration force and elasticity, the apparatus including: an unwinder that unwinds a predetermined amount of wound melt-blown fiber web; a transfer unit that transfers the unwound melt-blown fiber web; a cutting and sealing unit that cuts and fuses a surface of the transferred melt-blown fiber web in predetermined patterns; and a winding roll that winds the melt-blown fiber web.

According to various embodiments, the cutting and sealing unit includes a rolling roll that has knives having a predetermined shape that are arranged on an outer circumferential surface of the cutting and sealing unit at predetermined intervals. Preferably, such a cutting and sealing unit pressurizes the surface of the melt-blown fiber web at predetermined intervals by rotating the knives so that the melt-blown fiber web is cut and sealed.

According to various embodiments, the cutting and sealing unit includes a press mold that has knives having a predetermined shape arranged on a bottom surface of the cutting and sealing unit at predetermined intervals. Preferably, such a cutting and sealing unit pressurizes the surface of the melt-blown fiber web at predetermined intervals by vertically moving the knives so that the melt-blown fiber web is cut and sealed.

According to various embodiments, the cutting and sealing unit includes a press mold that has knives having a predetermined shape arranged on a bottom surface of the cutting and sealing unit at predetermined intervals. Preferably, such a cutting and sealing unit vertically moves the knives, and pressurizes the surface of the melt-blown fiber web at predetermined intervals using a steel plate as a support plate so that the melt-blown fiber web is cut and sealed.

According to various embodiments, when cutting portions and sealing portions are formed on the melt-blown fiber web using the knives, the sealing portions are completely cut and sealed by a shearing force of the knives. In particular, the sealing portions may be cut according to a thickness of a blade of each of the knives. Alternatively, the sealing portions may be cut with a minimum thickness of about 0.16 to 0.2 mm due to pressure of the knives. After cutting, the sealing portions are sealed.

Other aspects and exemplary embodiments of the invention are discussed infra.

BRIEF DESCRIPTION OF THE DRAWINGS

The above and other features and advantages of the present invention will become more apparent by describing in detail exemplary embodiments thereof with reference to the attached drawings in which.

Figure 1:
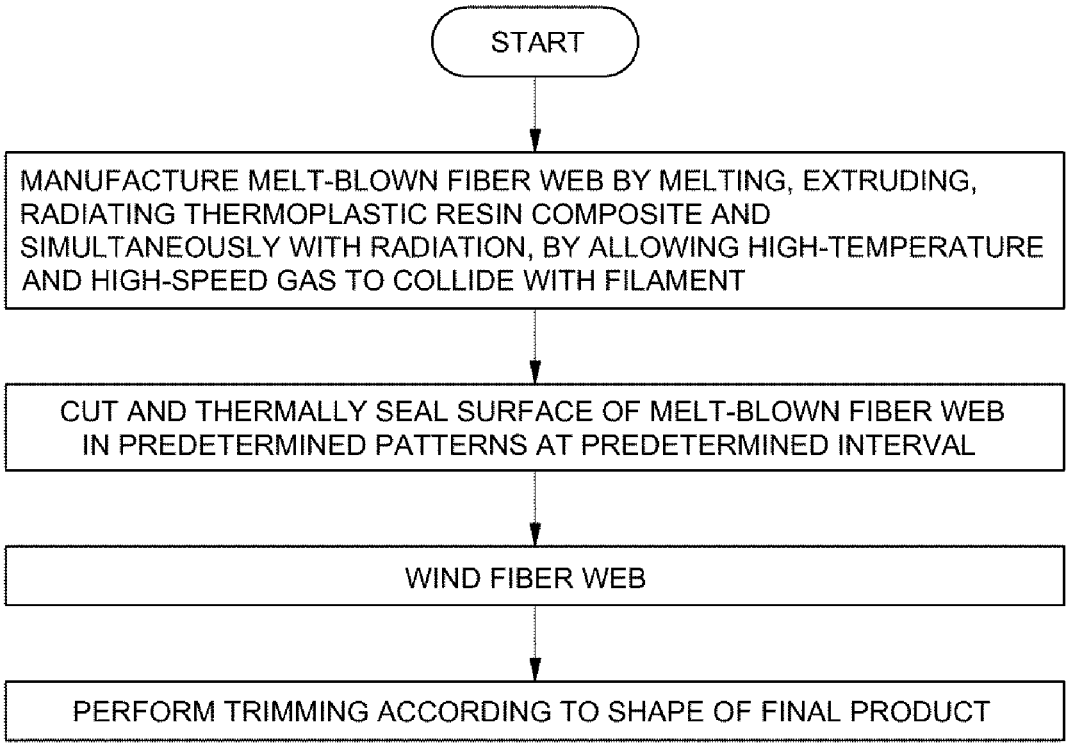
FIG. 1 is a flowchart illustrating a method of manufacturing a melt-blown fiber web according to an embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

The present invention will now be described more fully with reference to the accompanying drawings, in which exemplary embodiments of the invention are shown, so that one of ordinary skill in the art can easily embody the present invention.

The term "thermoplastic resin" as used in the present specification refers to a resin in which a process of applying heat with a higher temperature than a melting point to a polymer resin, melting, cooling, and solidifying the polymer resin can be repeatedly performed.

The thermoplastic resin may be classified into a crystalline thermoplastic resin and an amorphous thermoplastic resin according to a degree of crystallinity of the polymer. The crystalline thermoplastic resin includes polyethylene, polypropylene, and nylon, and the amorphous thermoplastic resin includes polyvinyl chloride, and polystyrene.

The term "polyolefin" as used herein refers to hydrocarbon polymers with a saturated open chain including carbon and hydrogen. General polyolefins include various mixtures of polyethylene, polypropylene, polymethylene and ethylene, or propylene and methlypentene monomer.

The term "polypropylene (PP)" as used herein refers to single polymer of propylene or a copolymer that is the unit of propylene with a 40% or more repetition unit.

The term "polyester" as used herein refers to polymer that is connected by formation of an ester unit and is a condensation product of dicarboxylic acid and dihydroxy alcohol with a 85% or more repetition unit. This includes aromatic, aliphatic, saturated and unsaturated diacid and di-alcohol. The term "polyester" as used herein further refers to copolymer, a blend, or a modified product thereof. A general example of a polyester is polyethylene terephthalate (PET), which is a condensation product of ethylene glycol and terephthalic acid.

The terms "melt-blown fiber" and "melt-blown filament" as used herein refers to a fiber or filament that is formed by extruding a molten porous polymer together with a high-temperature and high-speed compressed gas through a plurality of fine capillary tubes.

Here, the capillary tubes may be modified in various ways, such as a tube having a circular cross-section, a tube having a polygonal (triangular or rectangular) cross-section, or a tube having an asterisk shaped cross-section. Also, for example, the high-temperature and high-speed compressed gas may be used to cause a filament formed of molten thermoplastic copolymer to be thin, and may, for example, reduce a diameter of the filament to about 0.3 to 10 μm. The melt-blown fiber may be a discontinuous or continuous fiber.

The term "spunbond" as used herein refers to a fiber web that is manufactured by extending a plurality of filaments having a fine diameter that are extruded through capillary tubes by using a high-temperature tube. The spunbond fiber is continuous in a lengthwise direction of the filament, and the average diameter of the plurality of filaments is larger than about 5 μm. A spunbond nonwoven product or nonwoven web is formed by irregularly arranging spunbonds on a collection surface, such as a porous screen or belt.

The terms "nonwoven product, fiber web, and nonwoven web" as used herein refer to a structure including individual fibers, filaments, or threads that form a planar material by arranging the individual fibers, filaments, or threads in an irregular manner without patterns. Such a structure is in contrast to a knitted product.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinafter, exemplary embodiments of the present invention will be described in detail with reference to the accompanying drawings.

Figure 2:
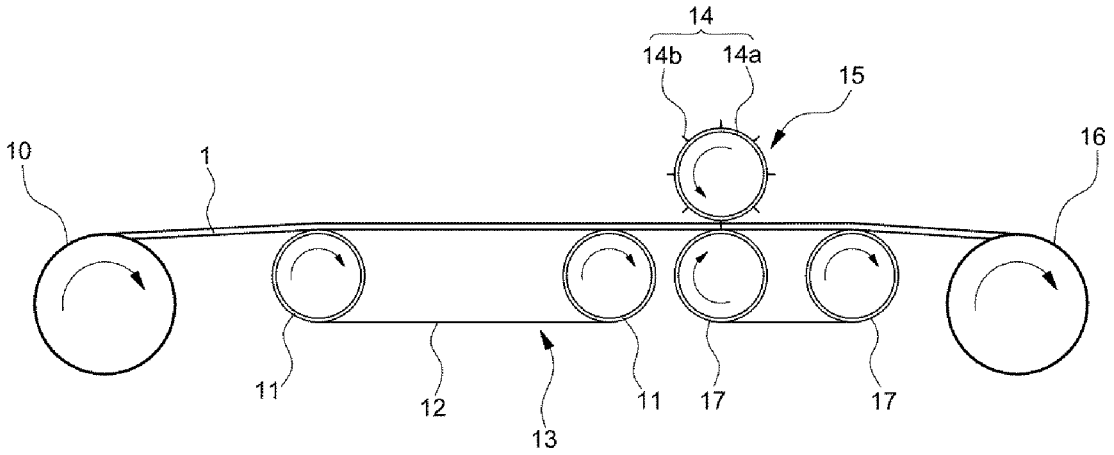
FIG. 2 is a side view of an apparatus for manufacturing a melt-blown fiber web according to an embodiment of the present invention.
Figure 4:
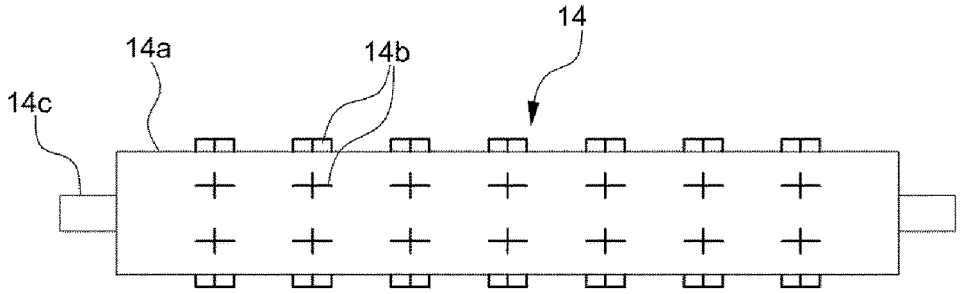
FIG. 4 is a plan view of a rolling roll of a device for cutting and sealing a melt-blown fiber web of the apparatus illustrated in FIG. 2.

FIG. 1 is a flowchart illustrating a method of manufacturing a melt-blown fiber web according to an embodiment of the present invention, FIG. 2 is a side view of an apparatus for manufacturing a melt-blown fiber web according to an embodiment of the present invention, and FIG. 4 is a plan view of a rolling roll 14 of a device for cutting and sealing a melt-blown fiber web of the apparatus illustrated in FIG. 2.

First, filaments are made to have a small diameter of about 0.3 to 10 μm by melting, extruding, and radiating a thermoplastic resin composite through a filament radiation tube. Further, a high-temperature and high-speed gas is caused to collide with the radiated filaments simultaneously with radiation, thereby manufacturing a melt-blown fiber web 1.

The melt-blown fiber web 1 may be manufactured generally by a method and apparatus for manufacturing a melt-blown fiber web disclosed in Korean Patent Laid-open Publication No. 2011-0122566 filed by the present applicant.

According to the present invention, a concentration force and elasticity of the melt-blown fiber web 1 is reinforced by cutting and sealing portions of the melt-blown fiber web 1. In particular, according to various embodiments, portions are cut and sealed by pressurizing knives 14*b* having a predetermined shape. As such, the pressurizing knives 14*b* come into contact with the melt-blown fiber web 1 manufactured using the above method in predetermined patterns.

A process of cutting and sealing the surface of the melt-blown fiber web 1 is performed after the melt-blown fiber web 1 has been formed and before the fiber web 1 of a final product is wound. Preferably the cutting and sealing are simultaneously performed.

According to an embodiment of the present invention, a device for cutting and sealing the surface of the melt-blown fiber web 1 includes an unwinder 10 that unwinds the wound melt-blown fiber web 1 at a predetermined speed, a transfer unit 13 that transfers the fiber web 1 that has been unwound by the unwinder 10 to a cutting and sealing unit 15, and a cutting and sealing unit 15 that cuts and seals the fiber web 1 that has been transferred by the transfer unit 13.

The device for cutting and sealing the surface of the melt-blown fiber web 1 having the above structure may be disposed inline with an existing apparatus for manufacturing a melt-blown fiber web. As such, the cutting and sealing device may manufacture the fiber web 1 continuously.

According to various embodiments, the unwinder 10 is a device for supplying the melt-blown fiber web 1, which preferably has a diameter of 0.3-10 μm and is formed in the above step, to the cutting and sealing unit 15. The unwinder 10 may be configured and arranged to unwind the fiber web 1 by rotation from a cylindrical roll on which the melt-blown fiber web 1 is wound.

As shown in the embodiment of FIG. 2, the transfer unit 13 can have two transfer rollers 11 that are connected to a belt 12, such as a conveyor belt. The two transfer rollers 11 can be rotated by a driving unit, such as a motor, based on the speed of the unwinder 10 to transfer the melt-blown fiber web 1 mounted on the conveyor belt 12 continuously in a horizontal direction.

The cutting and sealing unit 15 as shown in the embodiment of FIG. 2, can include the rolling roll 14, which is disposed over the fiber web 1, and support and transfer rollers 17 that are disposed under the fiber web 1 at predetermined intervals in the horizontal direction.

The rolling roll 14 and the support and transfer rollers 17 are disposed relative to each other to provide a predetermined gap in a vertical direction therebetween through which the fiber web 1 passes.

As shown in FIG. 2, the rolling roll 14 may include a cylindrical roll body 14*a*, and knives 14*b* or other forms of sharpened projections (hereinafter generally referred to as knives) disposed on an outer circumferential surface of the roll body 14*a* at predetermined intervals, for example as illustrated in FIG. 4.

As illustrated in FIG. 4, the rolling roll 14 may be coupled in a hinged structure by a rotation shaft 14*c*, which is formed integrally with both ends of the rolling roll 14 and protrudes therefrom. The rotation shaft may be connected to a motor or the like so as to rotate the rolling roll 14 using a driving force of the motor.

The knives 14*b* may protrude from the outer circumferential surface of the roll body 14*a* of the rolling roll 14 at predetermined intervals in a lengthwise direction and a circumferential direction and may cut and seal the melt-blown fiber web 1 in predetermined patterns, for example, by vertically pressurizing the surface of the fiber web 1 as it is transferred in the horizontal direction.

Figure 7:
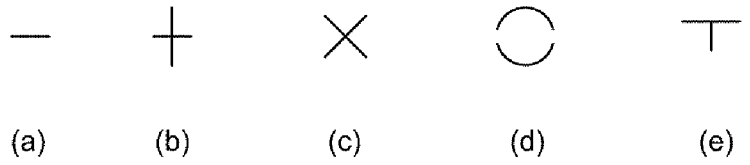
FIG. 7 is a schematic view of various patterns of cutting and sealing knives according to an embodiment of the present invention.

FIG. 7 is a schematic view of various patterns that may be made by the cutting and sealing knives 14*b* according to embodiments of the present invention. As shown, the knives 14*b* may be straight-line shaped (–), cross-shaped (+), x-shaped (X), a circle in which a hole is formed in a direction of a diameter of the knives 14*b* (○), or T-shaped, for example.

In this case, the cross-section of the knives 14*b* that contact the fiber web 1 may be minimized so as to minimize the damage of the fiber web 1.

A method of forming predetermined patterns on the surface of the melt-blown fiber web 1 having the above structure will be described below.

When the fiber web 1 is allowed to pass through a space between the rolling roll 14 rotated by the motor and the support and transfer rollers 17, the knives 14*b* disposed on the outer circumferential surface of the rolling roll 14 apply a shearing force onto the surface of the fiber web 1. Due to characteristics of a thermoplastic resin used as a material for the melt-blown fiber web 1, when the shearing force is applied to the thermoplastic resin, heat is generated, and a top surface of the fiber web 1 is widened by the thickness of the knives 14*b* due to the shearing force and heat and is cut and simultaneously, a bottom surface of the fiber web 1 is sealed.

In this way, when cutting and sealing are performed using the shearing force of the knives 14*b*, patterns with a predetermined interval, such as a stitch mark, remain on the surface of the fiber web 1. In this manner, the cutting and sealing method using the knives 14*b* uses additional equipment, such as an existing high frequency treating device, or fixes the melt-blown fiber web 1 by using an adhesive or by sewing using threads, which is fundamentally different from reinforcing the concentration force of the fiber web 1. By mechanically rotating the sharp knives 14*b* to apply the shearing force to the thermoplastic resin, cutting and sealing are performed without degrading the inherent function of the fiber web 1. AS such, the concentration strength of the fiber web 1 can be easily reinforced.

In other words, the contact and pressurized area of the knives 14*b* and the fiber web 1 is minimized compared to an existing sewing process. As a result, damage to the fiber web 1 by pressurization is minimized, the conventional problem related to a very small thickness of the fiber web 1 is solved to thereby maintain the inherent function of the fiber web 1, the top surface of the fiber web 1 is somewhat widened, and the bottom surface of the fiber web 1 is fused by heat so that the fiber web 1 is provided with increased concentration strength and elasticity.

Here, the melt-blown fiber web 1 may be cut and sealed using heat that is naturally generated when it is cut by the knives 14*b*. Alternatively, the knives 14*b* may be heated at a predetermined temperature to provide for cutting and sealing. For example, in order to heat the knives 14*b*, the rolling roll 14 and the knives 14*b* may be heated using a heater mounted in the rolling roll 14.

As described above, when the fiber web 1 is cut and sealed by heat provided by the knives 14*b*, the concentration strength of the fiber web 1 can be maximized.

Figure 3A:
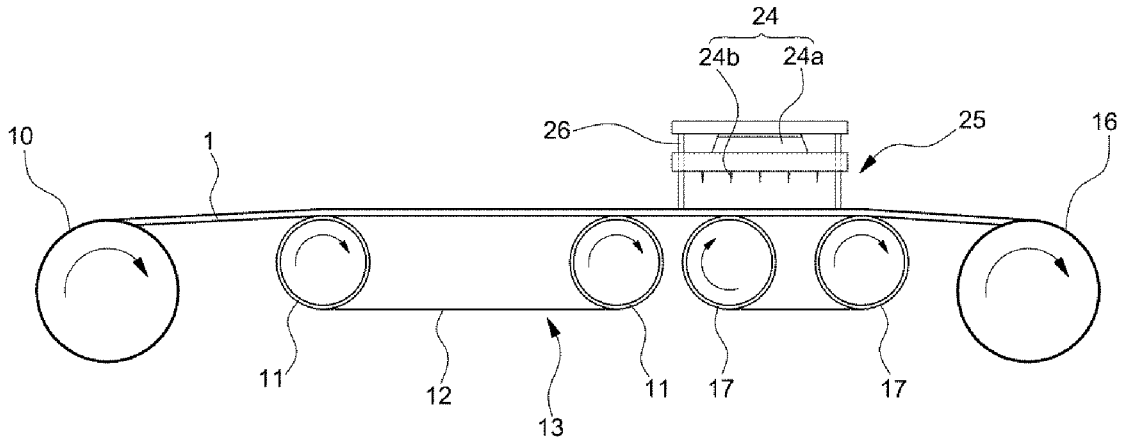
FIG. 3A is a side view of an apparatus for manufacturing a melt-blown fiber web according to another embodiment of the present invention.

FIG. 3A is a side view of an apparatus for manufacturing the melt-blown fiber 30 web 1 according to another embodiment of the present invention. As shown, the cutting and sealing unit 25 may be in the form of a press mold 24 that has a bottom surface of a mold body 24*a* of the press mold 24 on which knives 24*b* or other forms of sharpened projections (hereinafter generally referred to as knives) are mounted, and that is movable in a vertical direction.

According to an exemplary embodiment, the vertical movement of the press mold 24 is guided by guide bars 26 vertically disposed at corners of the press mold 24, and the press mold 24 is vertically driven by a hydraulic or pneumatic cylinder mechanism.

Again, the shape of the knives 24*b* may vary, as described above.

Figure 3B:
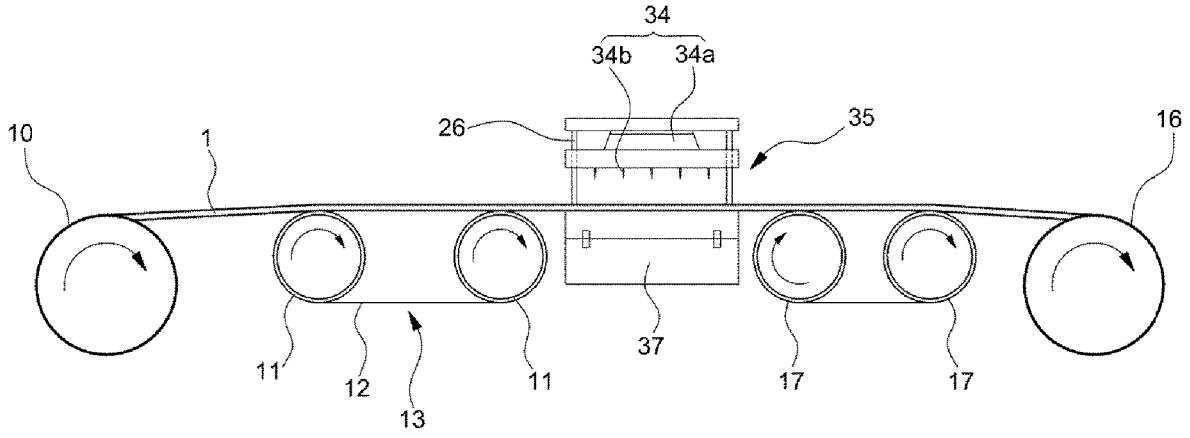
FIG. 3B is a side view of apparatus for manufacturing a melt-blown fiber web according to another embodiment of the present invention.

FIG. 3B is a side view of an apparatus for manufacturing the melt-blown fiber web 1 having a similar configuration as that in FIG. 3A, according to another embodiment of the present invention. A method of operating the apparatus of FIG. 3B is the same as or similar to the apparatus of FIG. 3A. As shown in FIG. 3B, the apparatus may be driven using a steel plate 37 as a support plate of knives 34*b* mounted on a bottom surface of a mold body 34*a* of a press mold 34.

Again, the shape of the knives 34*b* may vary, as described above.

Figure 5A:
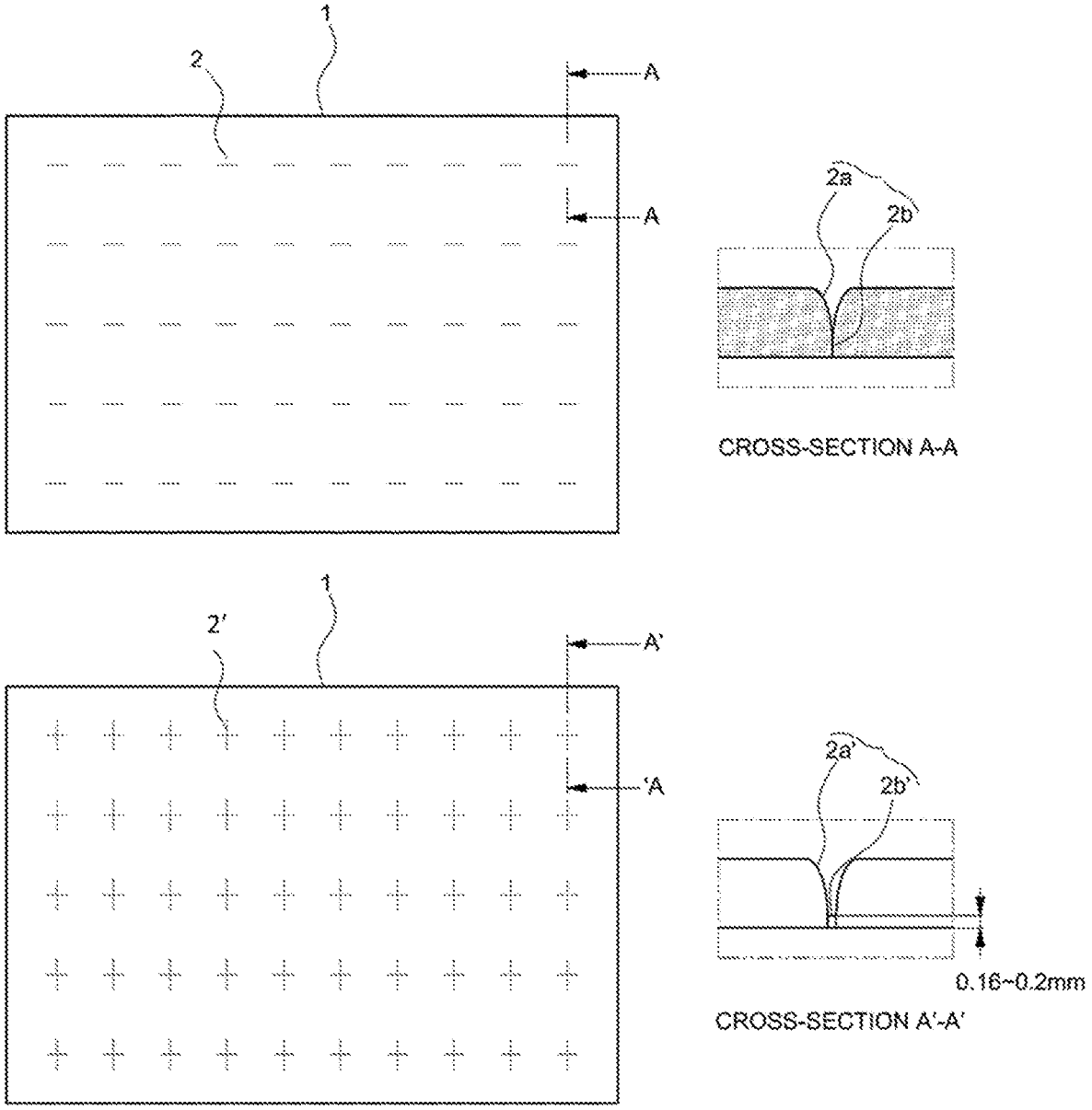
FIG. 5A is a plan view and a cross-sectional view of a melt-blown fiber web according to an embodiment of the present invention.

FIG. 5A is a plan view and a cross-sectional view of a melt-blown fiber web 1 according to an embodiment of the present invention. Referring to FIG. 5A, patterns having the same shape as straight-line shaped or cross-shaped knives 14*b*, 24*b*, and 34*b* are formed on the melt-blown fiber web 1 using cutting and sealing units 15, 25, and 35.

Next, the melt-blown fiber web 1 in which cutting portions 2*a* and 2*a*' and sealing portions 2*b* and 2*b*' with predetermined patterns are formed in the cutting and sealing process, is wound on a winding roll 16.

Here, the shape of the sealing portions 2*b* and 2*b*' may vary according to the thickness of a blade of the straight-line shaped or cross-shaped knives 14*b*, 24*b*, and 34*b*.

For example, if the thickness of a blade of each of the knives 14*b*, 24*b*, and 34*b* is small (e.g. about 0.05 to 0.1 mm), the blade itself is relatively very sharply ground, a shearing force is applied to the fiber web 1 due to the knives 14*b*, 24*b*, and 34*b*, and as indicated by a cross-section A-A, the fiber web 1 is completely cut from a top surface to a bottom of the fiber web 1 in a thickness direction so that the sealing portion 2*b* that is instantaneously sealed by heat can be formed.

However, if the thickness of the blade of each of the knives 14*b*, 24*b*, and 34*b* is large (e.g. about 0.1 to 1 mm), then the blade itself is relatively less sharply ground or as the usage period of the knives 14*b*, 24*b*, and 34*b* elapses, the blade becomes more dull, due to the pressure of the knives 14*b*, 24*b*, and 34*b*, as indicated by a cross-section A'-A'. Thus, a gap between the cutting portions 2*a*' on the top surface of the fiber web 1 is relatively large, and the sealing portion 2*b*' is not completely cut on the bottom of the fiber web 1. Rather, the sealing portion 2*b*' is connected to the bottom of the fiber web 1 with a minimum thickness (e.g. at least about 0.16 to 0.2 mm), or even in this case, the bottom of the sealing portion 2*b*' may be completely cut and then may be sealed.

The sealing portions 2*b* and 2*b*' emerge when a predetermined pressure is applied to the knives 14*b*, 24*b*, and 34*b*, as do the cutting portions 2*a* and 2*a'*.

According to various embodiments, the winding roll 16 may be rotatable by the rotation shaft 14*c* and may be rotated by a driving unit, such as a motor.

Finally, the wound melt-blown fiber web 1 based on the desired shape of the final product.

Figure 5B:
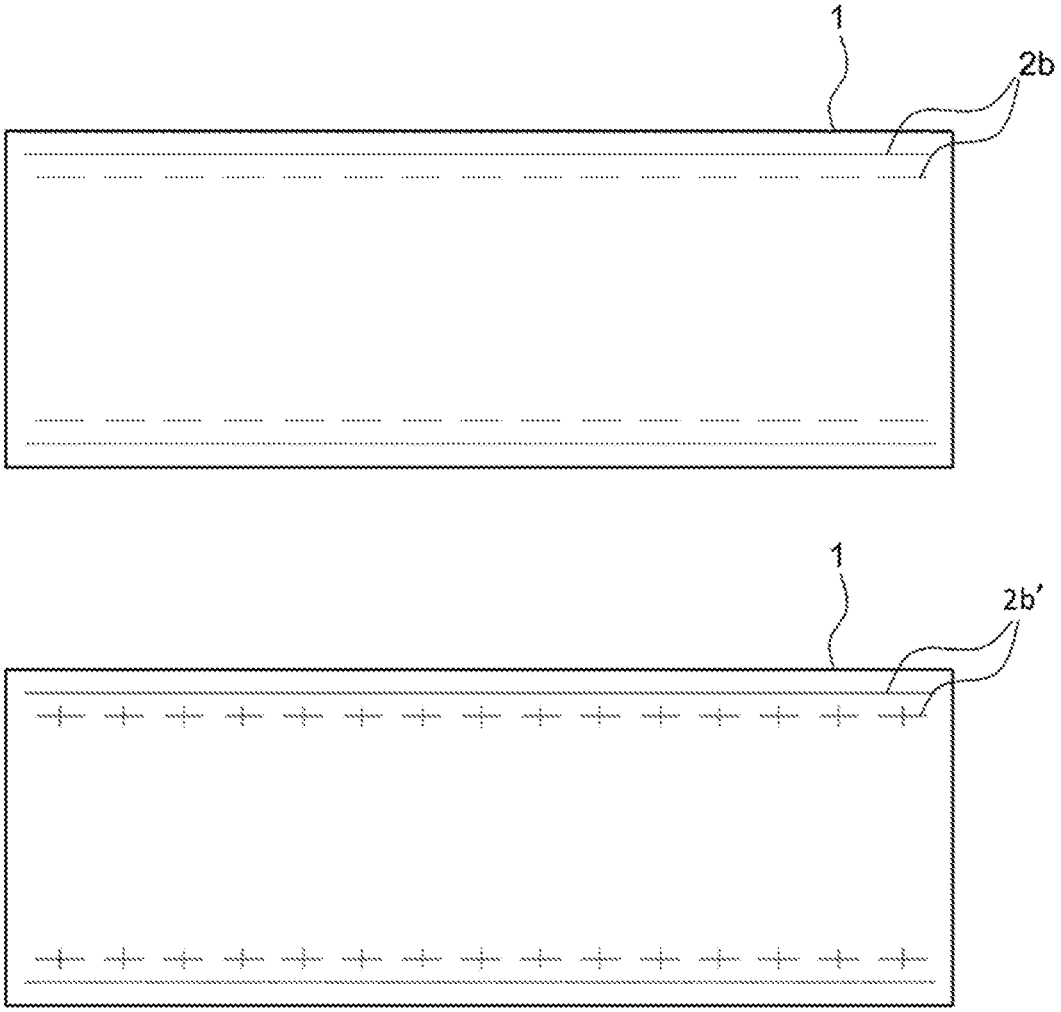
FIG. 5B is a plan view and a cross-sectional view of a melt-blown fiber web according to another embodiment of the present invention.

FIG. 5B is a plan view and a cross-sectional view of a melt-blown fiber web 1 according to another embodiment of the present invention. When straight line-shaped or cross-shaped knives 14*b*, 24*b*, and 34*b* are arranged at both corners of cutting and sealing units 15, 25, and 35, sealing portions 2*b* are formed at the corners of the melt-blown fiber web 1, as illustrated in FIG. 5B.

Figure 6:
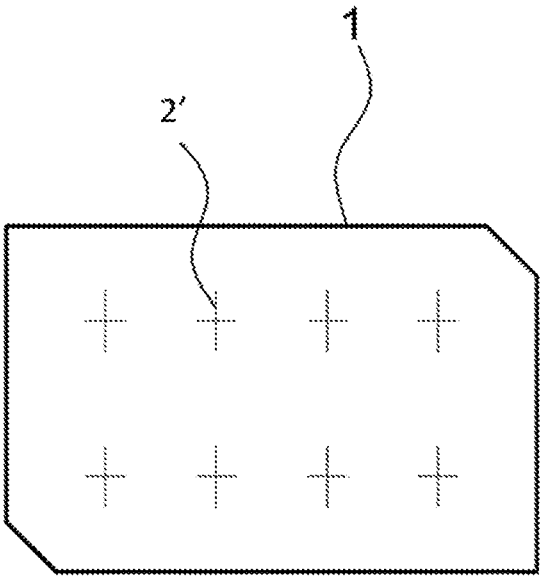
FIG. 6 is a plan view of a melt-blown fiber web that is cut in predetermined patterns, according to an embodiment of the present invention.

FIG. 6 is a plan view of a melt-blown fiber web that is cut in predetermined patterns, according to an embodiment of the present invention.

The composition of the melt-blown fiber web 1 according to the present invention may be modified in various ways according to the desired specifications of the final product. For example, the melt-blown fiber web 1 may include polyester, a staple fiber formed of olefin, and particles, in addition to a melt-blown fiber so as to provide various functions. Further, various types of surface protection layers, for example, spunbonds, nylon films, and aluminum foils, may be used to protect the surface of the melt-blown fiber web 1.

The shape of the knife 14*b* and an interval between the knives 14*b* that treat the surface of the melt-blown fiber web 1, may be freely adjusted according to a target property of the final fiber web 1.

Thus, according to the present invention, portions of the melt-blown fiber web 1 are cut and sealed by applying a shearing force to the surface of the melt-blown fiber web 1 using the rolling roll 14 or the press mold 24 having a surface on which the knives 14*b* are provided. The knives 14*b* may be provided to have a predetermined shape and may further be arranged at predetermined intervals. AS such, the concentration force and elasticity of the melt-blown fiber web 1 can be easily improved without degrading the inherent function of the fiber web 1.

Hereinafter, the present invention will be described based on the following examples; however, aspects of the present invention are not limited thereto.

Embodiment 1

A melt-blown fiber web was manufactured according to the present invention by using the same method as the process of manufacturing the melt-blown fiber web of FIG. 1. Detailed manufacturing conditions are as below.

A melt-blown fiber having a weight of 200 g/m$^2$, in which 20 wt % of a staple fiber formed of polypropylene and having an average thickness of 6 denia and an average length of 40 mm, of which a surface was treated with a silicon emulsifier, was randomly mixed with 80 wt % of a melt-blown microfiber formed of polypropylene and having an average thickness of 3 μm, and was manufactured using a vertical melt-blown manufacturing apparatus. The manufactured melt-blown fiber web was wound to a width of 1,800 mm and a length of 50 m.

Both sides of the wound melt-blown fiber web were combined with a spunbond nonwoven fabric having the weight of 15 g/m$^2$ so as to manufacture a melt-blown fiber web having a total weight of 230 g/m$^2$ and a thickness of 13 mm.

After the melt-blown fiber web that was wound with the width of 1,800 mm and the length of 50 m was positioned in a state in which the melt-blown fiber web was wound on the unwinder 10, as illustrated in FIG. 2, the melt-blown fiber web was put on a transfer unit having a width of 2,100 mm and a length of 3 m and was transferred.

The speed of the transfer unit was 5 m per minute. The transferred melt-blown fiber web was allowed to be passed through the rolling roll 14 having a length of 2,000 mm in which cross-shaped knives 14*b* (thickness: 0.7 mm/height: 8 mm) having a width of 15 mm and a length of 10 mm were arranged at an interval of 20 mm, thereby cutting and thermally sealing the surface of the melt-blown fiber web.

COMPARATIVE EXAMPLE

Samples were extracted from a conventional melt-blown fiber web not in accordance with the present invention. In particular, a conventional melt-blown fiber comprises a mixing part, wherein a resin composition consisting of thermoplastic resin, an antioxidant, a heat stabilizer, etc., are mixed; a drying part, wherein the water contained in the thermoplastic resin composition supplied from the mixing part is removed by drying before it is inputted into a heat extrusion part; a heat extrusion part, wherein the thermoplastic resin composition supplied from the drying part is subjected to heating, milling, melting, and extrusion; a melt-blown fiber radiating part, wherein the thermoplastic resin composition supplied from the heat extrusion part radiates fibers in the form of a filament(ultrafine fiber); a gas injection part, wherein a gas whose injection speed and injection amount are varied randomly and continuously, is radiated into the melt-blown fiber being radiated from the melt-blown fiber radiating part; a collection part, wherein the melt-blown fiber is collected and forms a melt-blown fiber web; and a winding part, wherein the fiber well formed in the collection part is wound. That is, the melt-blown fiber refers to a fiber formed by extrusion of a melted processable polymer via a plurality of minute capillary tubes along with a compressed gas under high temperature and high pressure. Here, the capillary tubes may be provided in various forms including a tube with a circular cross-section, a tube with a polygonal cross-section including triangular, and tetragonal shape, and a tube with a star shape. It is noted that the compressed gas under high temperature and high pressure enables a reduction in the diameter of the fiber of a melted thermoplastic polymer material to about 0.3 to about 10 μm. The melt-blown fiber may be a continuous or discontinuous fiber.

EXPERIMENTAL EXAMPLE

The effect of the melt-blown fiber web manufactured according to Embodiment 1 of the present invention was demonstrated by changing experimental conditions, and experimental results thereof are as follows.

The thickness of a sample manufactured by the method according to Embodiment 1 was measured using the following method.

After five samples having the shape of a square having the size of 100 mm×100 mm were extracted from arbitrary places of the melt-blown fiber web based on an international thickness measurement standard ISO 5084, a circular pressurization plate having a diameter of 100 mm was placed on the five samples so that a total sum of pressure applied to the five samples was 0.1 kPa. The thickness of each sample was then measured using vernier calipers, and an average value thereof was indicated as a representative value.

Thickness measurements after the samples were pressurized, were carried out in such a way that five samples having the shape of a square having the size of 100 mm×100 mm were extracted from arbitrary places of the melt-blown fiber web, a pressurization plate having the weight of 1 kg and the size of 120 mm×120 mm was put on the five samples, was left for 24 hours in a state in which humidity was 50% and temperature was kept at 25° C. After 2 hours elapses from time when the pressurization plate was removed, the thickness of each sample was measured using vernier calipers, and an average value thereof was indicated as a representative value.

A test for the concentration force of the samples was carried out in such a way that both surfaces of the fiber web were pulled out at a speed of 25 mm per minute based on GMW 14695 so as to measure a maximum load in which concentration was destroyed. Absorption performance of samples having the size of 1,000 mm×1,200 mm was tested using a reverberant chamber in which the samples were placed, based on a technical standard GM 141777, and test results thereof are shown in the following Table 4.

TABLE 1

| Concentration destruction strength of fiber web | |
|---|---|
| | Concentration destruction strength |
| Embodiment 1 | 51 N/cm$^2$ |
| Comparative example 1 | 40 N/cm$^2$ |

TABLE 2

| Thickness of fiber web before pressurization | |
|---|---|
| | Thickness |
| Embodiment 1 | 13 mm |
| Comparative example 1 | 13 mm |

TABLE 3

| Thickness of fiber web after pressurization | |
|---|---|
| | Thickness |
| Embodiment 1 | 13 mm |
| Comparative example 1 | 13 mm |

TABLE 4

| Absorption performance | | | | | | | | | | | | | | | |
|---|---|---|---|---|---|---|---|---|---|---|---|---|---|---|---|
| | 400 | 500 | 630 | 800 | 1k | 1.25k | 1.6k | 2k | 2.5k | 3.15k | 4k | 5k | 6.3k | 8k | 10k |
| Embodiment 1 | 0.32 | 0.35 | 0.51 | 0.62 | 0.80 | 0.86 | 0.87 | 0.93 | 0.99 | 0.98 | 0.97 | 0.91 | 0.87 | 0.86 | 1.06 |
| Comparative example 1 | 0.32 | 0.36 | 0.51 | 0.61 | 0.80 | 0.86 | 0.88 | 0.93 | 0.98 | 0.98 | 0.97 | 0.90 | 0.88 | 0.86 | 1.06 |

Figure 8:
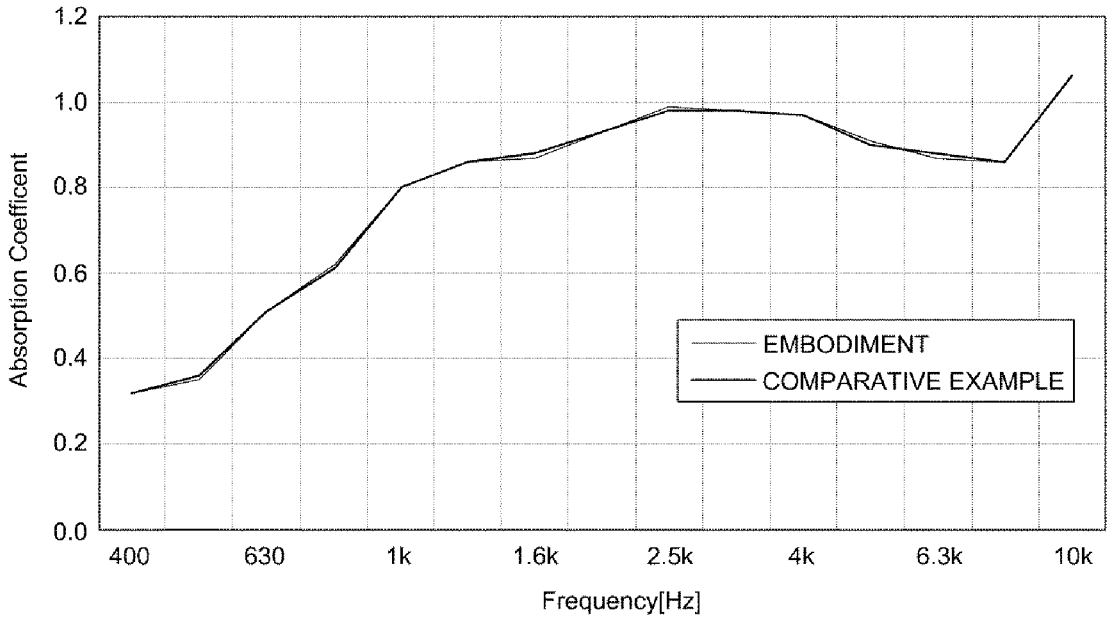
FIG. 8 is a graph showing the result of testing absorption performance of a melt-blown fiber web according to the present invention and absorption performance of a melt-blown fiber web according to the related art.

As illustrated in FIG. 8, as a result of testing, the fiber web according to the present invention, of which a surface was cut and sealed at predetermined intervals, demonstrated almost the same absorption performance as the comparative example.

The thickness of the fiber web was the same in Embodiment 1 and the comparative example. The thickness of the fiber web after pressurization was restored by 100% in Embodiment 1, whereas, in the comparative example, about 8% of a thickness loss occurred.

Also, concentration destruction strength of Embodiment 1 was increased by about 28% compared to the comparative example.

After considering all test results, in the melt-blown fiber web that was manufactured according to the present invention, elasticity and concentration force was improved without degrading the inherent characteristics of the fiber web, such as absorption performance.

As described above, the advantages of a melt-blown fiber web with improved concentration force and elasticity and a method and apparatus for manufacturing the melt-blown fiber web are as follows.

Firstly, a plurality of cutting portions and a plurality of sealing portions are formed in predetermined patterns on the surface of the melt-blown fiber web so that a concentration force between microfibers that form the melt-blown fiber web can be increased and a melt-blown fiber web with reinforced concentration force can be manufactured.

Secondly, the elasticity of the melt-blown fiber web can be improved by the plurality of cutting portions and the plurality of sealing portions that are formed in the predetermined patterns on the melt-blown fiber web.

Thirdly, patterns and shapes of the cutting portions and the sealing portions formed on the melt-blown fiber web may be varied so that the concentration force and elasticity of the fiber web can be tailored to manufacture a desired melt-blown fiber web.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing a melt-blown fiber web, the method comprising:

manufacturing a melt-blown fiber web by a wave forming process in which filaments are extended and are formed into a wave by spraying a thermoplastic resin onto the filaments in a vertical downward direction so as to allow a predetermined temperature and predetermined speed gas having constant temperature, pressure, and speed to collide with the filaments, and further including collecting and stacking the filaments in which the wave is formed to thereby form the fiber web;

forming cutting portions and sealing portions in the melt-blown fiber web at predetermined patterns and at predetermined intervals, wherein the cutting portions are formed by applying a shearing force to a top surface of the manufactured melt-blown fiber web using knives and the sealing portions are formed by fusing the melt-blown fiber web by heat at a bottom surface of the manufactured melt-blown fiber web; and winding the melt-blown fiber web in which the cutting portions and the sealing portions are formed, wherein the cutting portions and the sealing portions are arranged repeatedlly on the top surface of the melt-brown fiber web and the bottom surface of the melt-blown fiber web, respectively, wherein the cutting portion includes a slit formed on the top surface of the melt-blown fiber web, and the cutting portion and the sealing portion are formed in a same line along a thickness direction of the melt-blown fiber web or a cross-section of a single layer of the melt-blown fiber web, wherein the slit is formed at the cutting portion on the top surface of the melt-blown fiber web by the knives applying the shearing force, and the sealing portion is sealed by heat after the shearing force and connected to the bottom surface of the melt-blown fiber web, wherein the top surface of the melt-blown fiber web is widened and the bottom surface of the melt-blown fiber web is fused by heat such that a gap at the cutting portion on the top surface of the melt-blown fiber web is greater in a width direction than a gap at the sealing portion.

2. The method of claim 1, wherein a shape of each of the cutting portions and the sealing portions is selected from the group consisting of a straight line shape, a cross shape, an X-shape, a circle, and a T-shape, and a combination thereof.

* * * * *